US006956334B2

(12) United States Patent
Oh

(10) Patent No.: US 6,956,334 B2
(45) Date of Patent: Oct. 18, 2005

(54) FIELD EMISSION DISPLAY HAVING CARBON-BASED EMITTERS

(75) Inventor: Tae-Sik Oh, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 35 days.

(21) Appl. No.: 10/645,812

(22) Filed: Aug. 21, 2003

(65) Prior Publication Data

US 2004/0155572 A1 Aug. 12, 2004

(30) Foreign Application Priority Data

Aug. 21, 2002 (KR) ..... 10-2002-0049480

(51) Int. Cl.[7] ..... G09G 3/10; H01J 1/62
(52) U.S. Cl. ..... 315/169.3; 313/495
(58) Field of Search ..... 313/309, 336, 313/351, 495, 553, 558, 559; 315/169.3, 169.4

(56) References Cited

U.S. PATENT DOCUMENTS 6,097,138 A * 8/2000 Nakamoto ..... 313/309
6,486,599 B2 * 11/2002 Wang et al. ..... 313/495
2001/0030507 A1 * 10/2001 Ono ..... 313/504
2004/0108515 A1 * 6/2004 Muroyama et al. ..... 257/144

* cited by examiner

*Primary Examiner*—Tuyet Vo
*Assistant Examiner*—Minh Dieu A
(74) *Attorney, Agent, or Firm*—Christie, Parker and Hale, LLP

(57) ABSTRACT

A field emission display includes a first substrate. At least one gate electrode is formed in a predetermined pattern on the first substrate. A plurality of cathode electrodes is formed in a predetermined pattern on the first substrate to form intersection regions with the at least one gate electrode. An Insulation layer is formed between the at least one gate electrode and the plurality of cathode electrodes. At least one pair of emitters is electrically connected to the cathodes electrodes. A second substrate is provided opposing the first substrate with a predetermined gap therebetween. At least one anode electrode is formed on the second substrate. Phosphor layers are formed on the second substrate electrically connected to the at least one anode electrode.

17 Claims, 7 Drawing Sheets

FIELD EMISSION DISPLAY HAVING CARBON-BASED EMITTERS

CROSS-REFERENCE TO RELATED APPLICATIONS

This application claims priority to and the benefit of Korean Application No. 2002-0049480, filed on Aug. 21, 2002 in the Korean Intellectual Property Office, the entire content of which is incorporated herein by reference.

BACKGROUND OF THE INVENTION (a) Field of the Invention

The present invention relates to field emission displays (FEDs), and more particularly, to FEDs having carbon-based emitters.

(b) Description of the Related Art

A typical FED uses a cold cathode as the source for emitting electrons to realize the display of images. The overall quality of the FED depends on material and structural characteristics of the emitters that form an electron emitting layer. The first FEDs utilizing emitters were made mainly of molybdenum (Mo). Subsequently, Spindt-type metal tip (or microtip) emitters were developed.

However, in manufacturing the FED having metal tip emitters, it is necessary to form extremely minute openings into which the emitters are provided and necessary also to deposit Mo and uniformly form the metal microtips over an entire region of a screen. As a result, production is complicated, and highly precise technology process and expensive equipment are required for manufacture such that unit costs tend to increase. Further, the difficult processes involved make it difficult to manufacture FEDs of a large screen size.

Accordingly, much research and development is being performed by those in the FED industry to form emitters in a flat configuration that enable good electron emission at low voltage driving conditions and are relatively simple to manufacture. It is known that carbon-based materials, for example, graphite, diamond, diamond-like carbon (DLC), $C_{60}$ (Fullerene), or carbon nanotubes (CNTs) are suitable for use in the manufacture of flat emitters. In particular, it is believed that CNTs, with their ability to realize favorable electron emission at relatively low driving voltages, is the ideal material for emitters in FEDs.

The FEDs using CNT technology typically employ a triode structure having cathodes, an anode, and gate electrodes. With these FEDs, cathode electrodes are first formed on a substrate. Then an insulating layer and gate electrodes including minute holes are deposited over the cathode electrodes. Emitters are then formed in the openings such that the emitters are positioned on the cathode electrodes.

However, with the FED having the above triode structure, a reduction in color purity occurs and it is difficult to realize sharp pictures. When the electrons emitted from the emitters form electron beams and travel toward phosphors, a diverging force of the electron beams is increased by a voltage (a positive voltage of a few volts to a few tens of volts) applied to the gate electrodes such that the electron beams scatter. The electron beams therefore land not only on the desired phosphors, but also on unintended phosphors to illuminate the same. Reduction in color results and sharp pictures become difficult to realize.

In order to prevent these problems, there are efforts to minimize the size of an emitter and deposit the emitter with the plural on an area corresponding to one phosphor such that scattering of the electron beams is minimized. However, there are limits to how small the emitters can be formed and problems occur with respect to phosphor illumination if the emitters are made too small. Difficulties with respect to focusing the electron beams also occur.

To prevent the scattering of the electron beams, a configuration in which additional electrodes for focusing the electron beams are mounted in the vicinity of the gate electrodes has been disclosed. However, such a structure is applied mainly to FEDs employing the microtip configuration and not to a structure of flat emitters, in which the resulting focusing effect is minimal.

SUMMARY OF THE INVENTION

In accordance with an exemplary embodiment of the present invention, a field emission display is provided that improves the structure of electron emission sources and the configuration for focusing electron beams formed by electrons emitted from the electron emission sources, thereby improving the overall quality of the field emission display.

In one exemplary embodiment, the present invention is a field emission display including a first substrate. At least one gate electrode is formed in a predetermined pattern on the first substrate. A plurality of cathode electrodes are also formed in a predetermined pattern on the first substrate, the cathode electrodes forming intersection regions corresponding to pixel regions with the at least one gate electrode. An Insulation layer is formed between the at least one gate electrode and the plurality of cathode electrodes to insulate these elements. At least one pair of emitters is connected to the cathode electrodes. A second substrate is provided opposing the first substrate with a predetermined gap therebetween, the first and second substrates forming a vacuum assembly when interconnected. At least one anode electrode is formed on a surface of the second substrate opposing the first substrate. Phosphor layers are formed on the second substrate electrically connected to the at least one anode electrode.

In an exemplary embodiment, the at least one pair of emitters is formed at a predetermined distance from each other and closely contacting the cathode electrode. Also, the emitters are longitudinal and extend in a direction of the pattern of the at least one gate electrode. In an exemplary embodiment, the emitters are carbon nanotubes.

In an exemplary embodiment, the at least one pair of emitters are formed in openings of the cathode electrodes in the intersection region or on the cathode electrodes in the intersection region. Further, the field emission display includes a metal mesh grid mounted between the first substrate and the second substrate including openings corresponding to the intersection regions.

DETAILED DESCRIPTION

Figure 1:
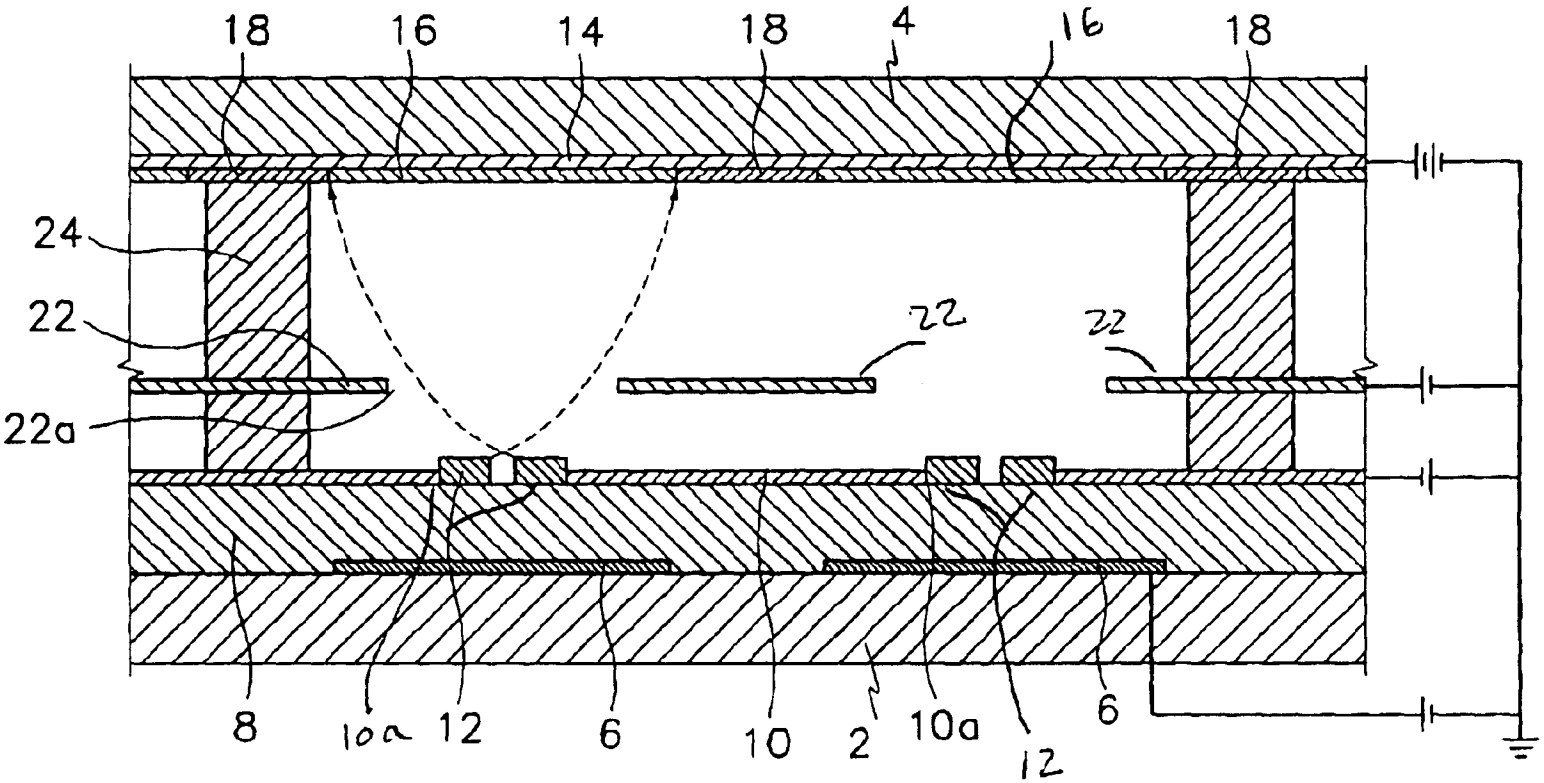
FIG. 1 is a partial sectional view of a field emission display according to a first embodiment of the present invention.
Figure 2:
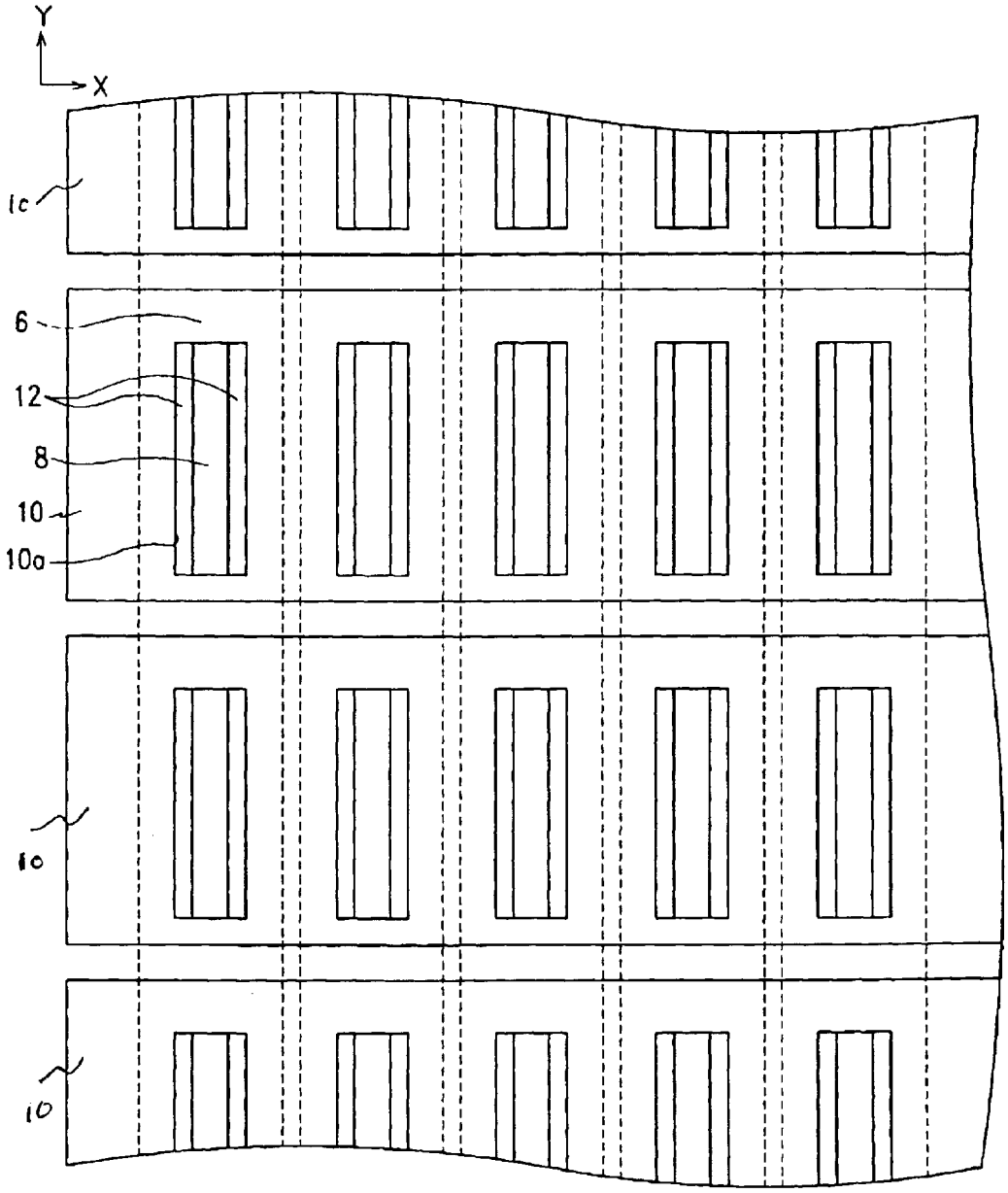
FIG. 2 is a partial plan view of the field emission display of FIG. 1.

FIG. 1 is a partial sectional view of a field emission display (FED) according to a first embodiment of the present invention, and FIG. 2 is a partial plan view of the field emission display of FIG. 1.

With reference to the drawings, the FED includes a first substrate 2 (hereinafter referred to as a lower glass substrate) of predetermined dimensions and a second substrate 4 (hereinafter referred to as an upper glass substrate) of predetermined dimensions. The upper glass substrate 4 is provided substantially in parallel to the lower glass substrate 2 with a predetermined gap therebetween. When interconnected, the lower and upper glass substrates 2 and 4 form a vacuum assembly that defines the FED.

A structure to enable the generation of electric fields is provided on the lower glass substrate 2 and a structure to enable the realization of predetermined images by electrons emitted as a result of the generated electric fields is provided on the upper glass substrate 4. These structures are described in more detail below.

A plurality of gate electrodes 6 is formed on the lower glass substrate 2 in a predetermined pattern (e.g., a striped pattern), at predetermined intervals, and along direction Y of the lower glass substrate 2. An insulation layer 8 is deposited at a predetermined thickness over an entire surface of the lower glass substrate 2 and covering the gate electrodes 6.

A plurality of opaque cathode electrodes 10 is formed on the insulation layer 8 at predetermined intervals and perpendicularly intersecting the gate electrodes 6 to form intersecting regions corresponding to pixel regions of the FED. That is, the cathode electrodes 10 are formed in a striped pattern along direction X, which is perpendicular to the direction Y, as shown in FIG. 2. Openings 10*a* that expose the insulation layer 8 are formed in the cathode electrodes 10 where the cathode electrodes 10 overlap the gate electrodes 6.

The openings 10*a,* with particular reference to FIG. 2, are substantially longitudinal with lengths in the Y direction. Such a longitudinal shape is used also for emitters and phosphor layers, described below. However, it should be noted that the present invention is not limited to the longitudinal shape used for these elements and it is possible to employ other configurations.

A pair of emitters 12 is formed on the insulation layer 8 in each of the openings 10*a.* Since it is necessary for the emitters 12 to be electrically connected to the cathode electrodes 10, the emitters 12 are mounted in the openings 10*a* contacting the cathode electrodes 10. That is, for each of the openings 10*a,* the corresponding two emitters 12 are provided therein extending in the direction Y and at opposite sides of the openings 10*a* closely contacting the corresponding cathode electrode 10 such that there is a predetermined gap between the two emitters 12.

The emitters 12 are formed in a flat configuration but having a thickness (as shown in FIG. 1) that is greater than a thickness of the cathode electrodes 10. Further, the emitters 12 emit electrons according to the emission of electric fields formed by applying voltages to the gate electrodes 6 and the cathode electrodes 10. In one embodiment of the present invention, the emitters 12 are formed of carbon-based material, for example, carbon nanotubes. In addition, the emitters 12 are formed in substantially the same longitudinal direction, as the openings 10*a,* that is, in a longitudinal configuration and extending in the direction Y, as shown in FIG. 2.

With respect to the upper glass substrate 4, an anode electrode 14 made of a transparent material, such as ITO is formed on a surface of the upper glass substrate 4 opposing the lower glass substrate 2. Also, phosphor layers 16 made of red (R), green (G), and blue (B) phosphors are formed on the anode electrode 14. The phosphors forming the phosphor layers 16 have a longitudinal pattern corresponding to the openings 10*a* of the cathode electrodes 10 and the emitters 12.

In addition, black matrix layers 18 are formed between the phosphor layers 16 to increase contrast, and a metal thin film layer (not shown) is formed over the phosphor layers 16 and the black matrix layers 18. The metal thin film layer enhances the ability to withstand voltages and brightness characteristics of the FED.

A metal mesh grid 22 is formed between the upper glass substrate 4 and the lower glass substrate 2. The mesh grid 22 focuses the electron beams generated by the emitters 12. The mesh grid 22 is made of alloyed steel such as AK (aluminum-killed) steel or Invar, and includes a plurality of openings 22*a* corresponding to the openings 10*a* of the cathode electrodes 10.

In the manufacture of the FED, the mesh grid 22 is sealed in a state where it is inserted in the position described above, that is, positioned so that the openings 22*a* of the mesh grid 22 are aligned with the openings 10*a* of the cathode electrodes 10. In more detail, the lower glass substrate 2 and the upper glass substrate 4 structured as described above are provided with a predetermined gap therebetween and in a state where the emitters 12 oppose the phosphor layers 16. Then with the mesh grid 22 positioned correctly, a sealant (not shown) is provided around a circumference of the lower and upper glass substrates 2 and 4 to thereby seal these elements with the mesh grid 22 positioned therebetween forming a single assembly. Spacers 24 are mounted before sealing the substrates 2 and 4 to maintain the gap therebetween. The spacers 24 are provided in non-pixel regions.

In the FED structured as described above, predetermined external voltages are applied to the gate electrodes 6, the cathode electrodes 10, the metal mesh grid 22, and the anode electrode 14 For example, a positive voltage of a few volts to a few tens of volts is applied to the gate electrodes 6, a negative voltage of a few volts to a few tens of volts is applied to the cathode electrodes 10, a positive voltage of a few volts to a few hundred volts is applied to the metal mesh grid 22, and a positive voltage of a few hundred to a few thousand volts is applied to the anode electrode 14. The cathode electrodes 10 would typically function as scanning electrodes while the gate electrodes 6 provide data information, or vice versa. As a result, electric fields are formed between the gate electrodes 6 and the cathode electrodes 10 (see equipotential lines 11 in FIG. 3A) such that electrons are emitted from the emitters 12. Also, the emitted electrons are formed into electron beams 13 (FIGs. 3A and 3B) and induced toward the phosphor layers 16 to land on the same, thereby illuminating the phosphor layers 16 to realize predetermined images.

During operation of the above FED, the metal mesh grid 22 performs focusing of the electron beams formed by the electrons emitted from the emitters 12, when they travel toward the phosphor layers 22.

Figure 3A:
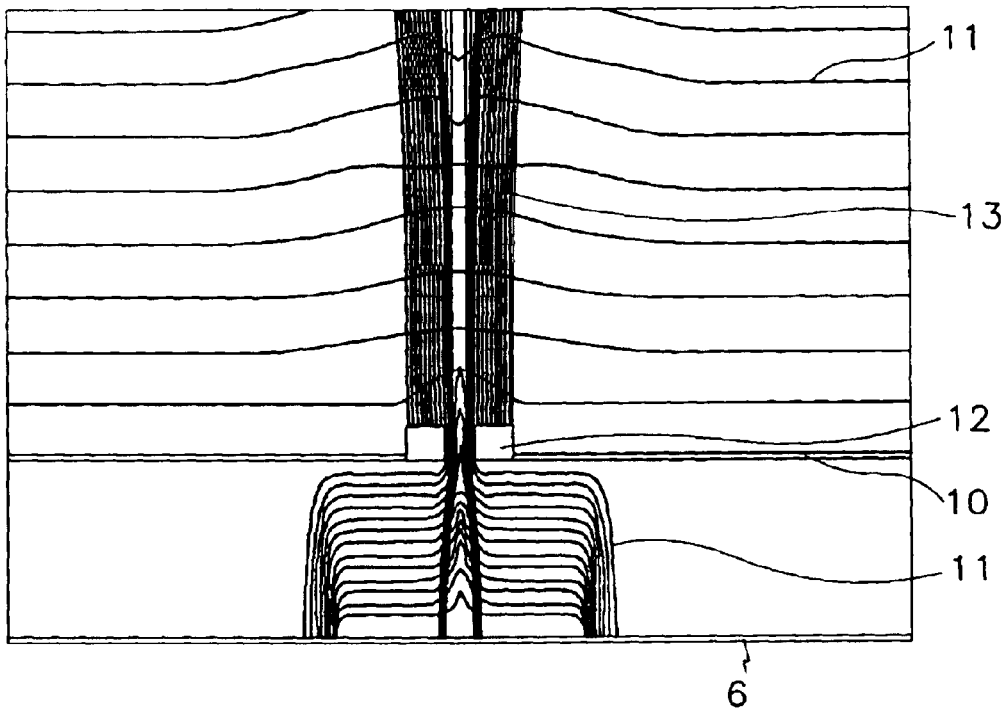
FIGS. 3A and 3B show results of a computer simulation illustrating the trace of electron beams emitted from emitters of the field emission display of FIG. 1.
Figure 3B:
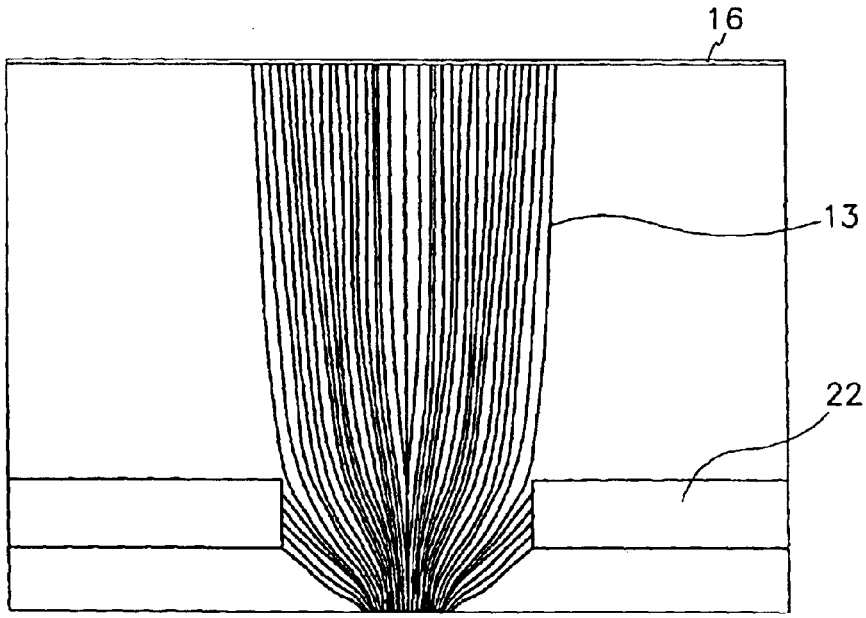

FIGS. 3A and 3B show results of a computer simulation illustrating the trace of electron beams emitted from emitters 12. FIG. 3A shows an overall trace of an electron beam traveling toward a corresponding phosphor layer 16, and FIG. 3B is an enlarged view showing a trace of an electron beam as it passes through the metal mesh grid 22.

Figure 4A:
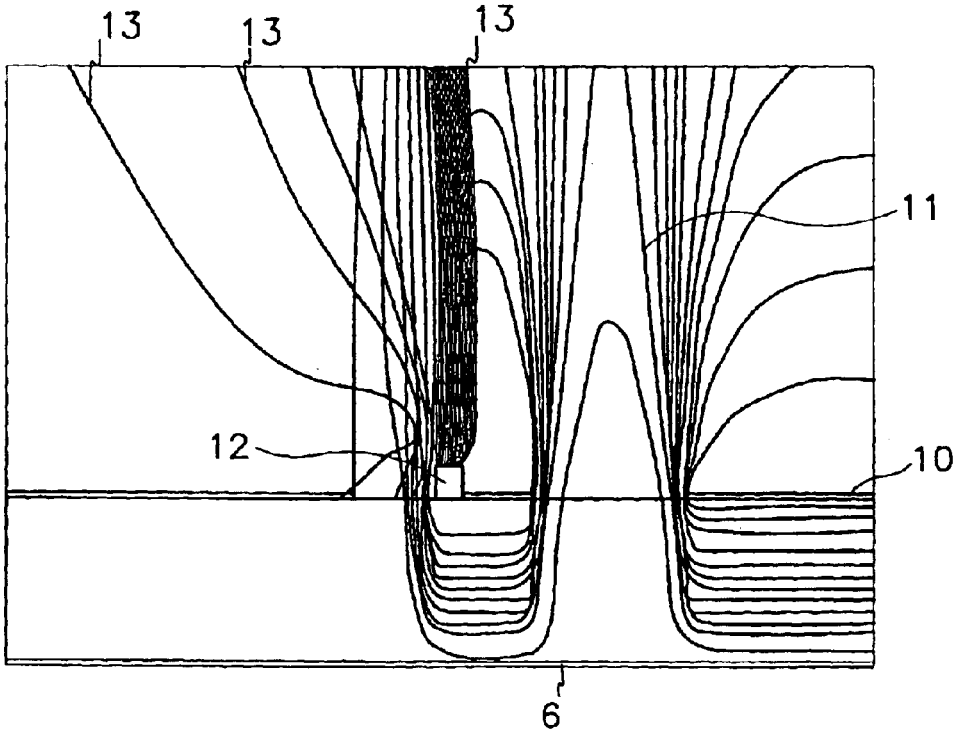
Fig. 4A (Prior Art)
FIGS. 4A and 4B show results of a computer simulation illustrating the trace of electron beams emitted from emitters of a conventional field emission display employing a triode structure.
Figure 4B:
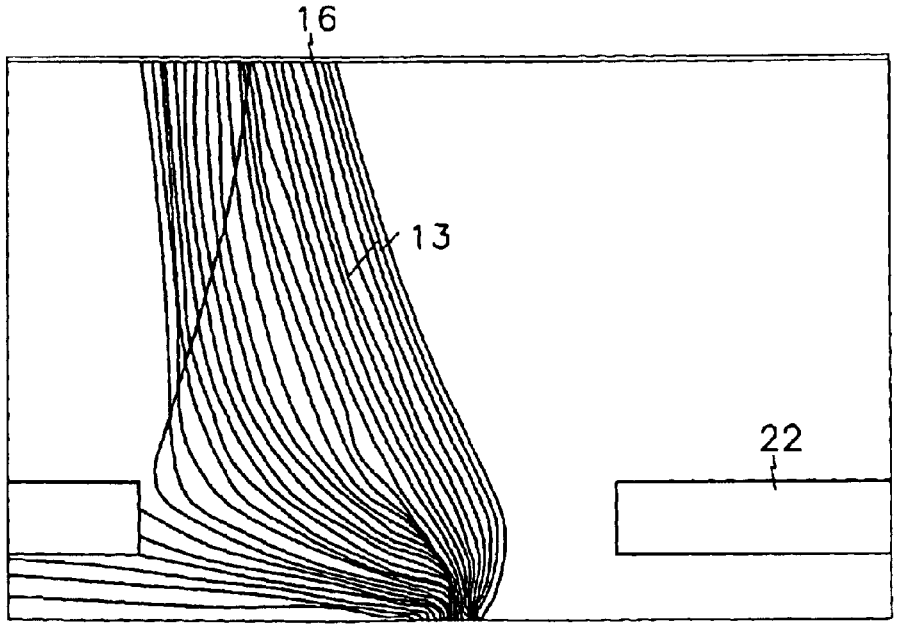
Fig. 4B (Prior Art)

As shown in the above drawings, an electron beam 13 emitted from the emitters 12 is directed toward a center of the pixel and does not lean in one direction with respect to pixels corresponding to each pixel of a phosphor layer, as shown in FIGS. 4A and 4B, which show the trace of an electron beam 13 generated in a conventional FED that uses a single emitter configuration rather than the paired-emitter configuration of the present invention.

Therefore, in the FED of the present invention, the electron beam 13 emitted from one of the emitters 12 lands only on the designated phosphor layer 16 and not on one of the adjacent phosphor layers 16 of a different color. As a result, the electron beams 13 are better concentrated on their intended phosphor layers 16 to illuminate the same.

Figure 5:
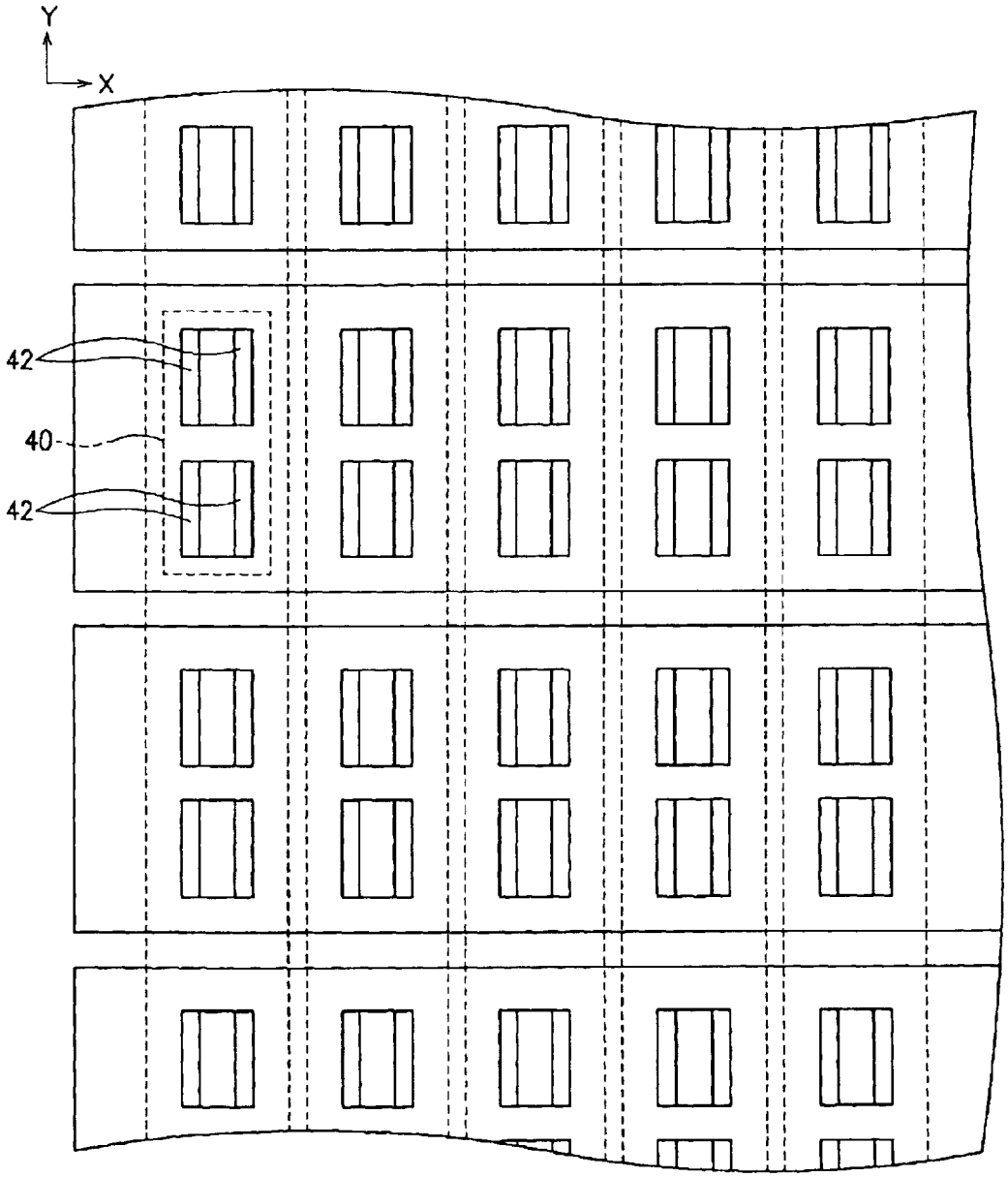
FIG. 5 is a partial plan view of a field emission display according to a second embodiment of the present invention.

FIG. 5 is a partial plan view of a field emission display according to a second embodiment of the present invention. In the FED of the second embodiment, emitters 42 corresponding to pixels are divided to two separate parts. That is, the emitters 42 are divided into two sections for each pixel 40. Except for such a division of the emitters 42, the remaining structures of the second embodiment of the present invention are identical to that described above with reference to the first embodiment. A detailed explanation of the remaining structures therefore will not be provided.

With such a division of the emitters 42 for each of the pixels 40, in addition to the advantages realized with the first embodiment, resolution is also improved.

In the FED of the present invention described above, the electron beams emitted from the emitters land only on the phosphor layers of the intended pixels. This is done while realizing a simple structure of forming emitters on a corresponding cathode electrode for each of the pixels. Therefore, a reduction in color purity by the electron beams landing on unintended phosphor layers is prevented.

Also, by the formation of the emitters in single structures, a greater number of electrons are emitted from the emitters such that better picture quality is realized. In addition, by increasing the area of the emitters, emitter durability is increased, especially when the FED is operated for long periods. Finally, with the division of the emitters for each of the pixels as in the second embodiment, picture resolution is significantly improved, thereby allowing the realization of high-quality digital images.

Figure 6:
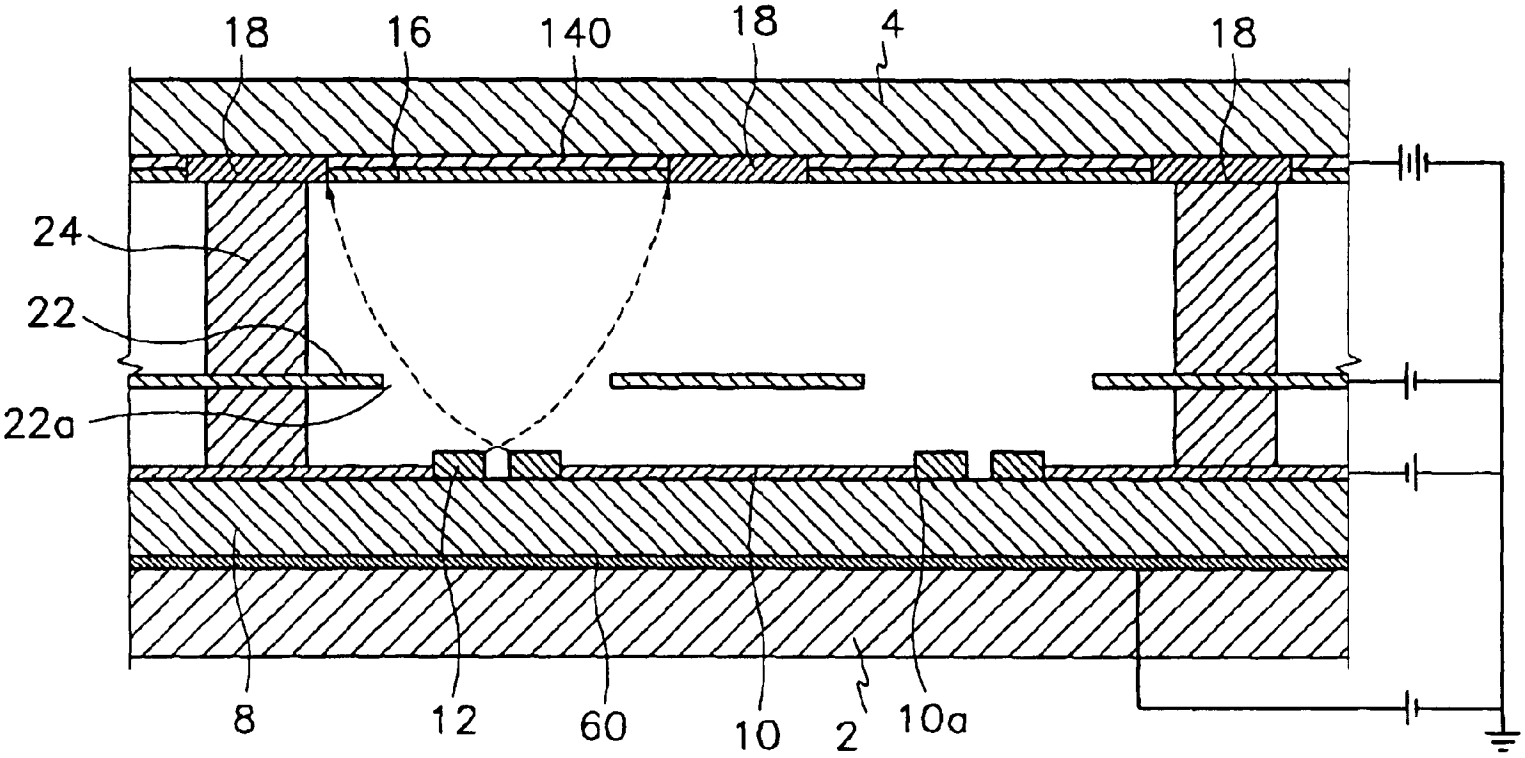
FIG. 6 and FIG. 7 are partial sectional views of a field emission display according to further embodiments of the present invention.

Referring now to FIG. 6, in one embodiment for example, at least one of the anode electrodes 140 can be formed in a striped pattern while having one gate electrode 60 function as the common electrode. The remaining portions and their functions would be the same as those described above for FIG. 1 and the alternative embodiment shown in FIG. 5. Those skilled in the art would then appreciate that the cathode electrodes could receive scanning information while the anode electrodes receive data information and vice versa.

An anode electrode in the various embodiments can be formed by a metal layer, rather than being made of transparent material such as ITO. When the anode electrode is formed by a metal layer, a phosphor layer is formed on a front substrate and the metal layer is formed on the phosphor layer.

Figure 7:
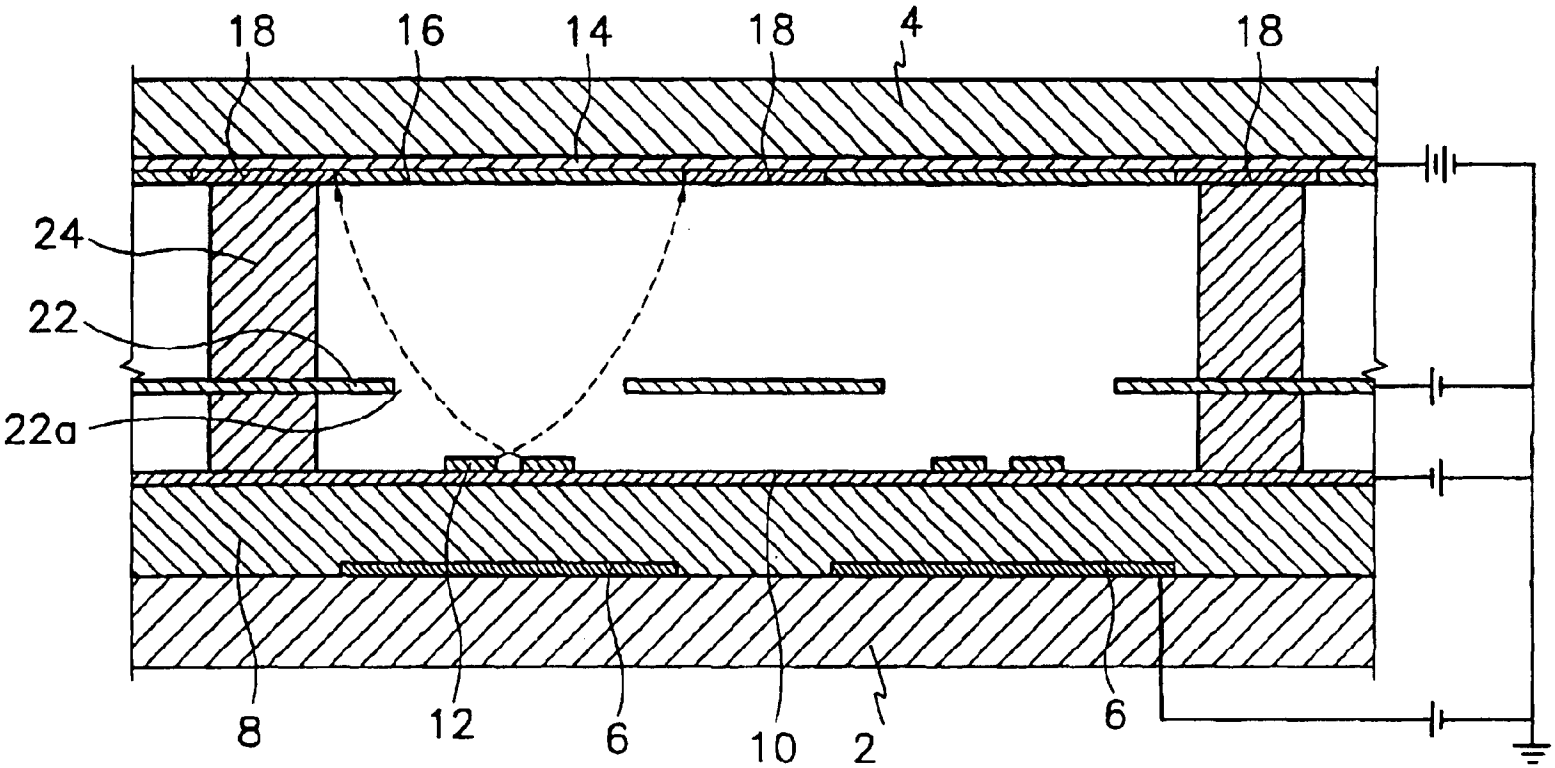

Further, in one embodiment of the present invention, the at least one pair of emitters can be formed on the cathode electrodes as shown in FIG. 7.

Although several embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A field emission display, comprising:

a first substrate;

at least one gate electrode formed in a predetermined pattern on the first substrate;

a plurality of cathode electrodes formed in a predetermined pattern on the first substrate, the plurality of cathode electrodes forming overlap regions corresponding to pixel regions with the at least one gate electrode and forming an opening between each pair of the plurality of cathode electrodes at a portion of the overlap regions;

an insulation layer formed between the at least one gate electrode and the plurality of cathode electrodes;

a pair of emitters formed in the opening and electrically connected to the cathode electrodes;

a second substrate opposing the first substrate with a predetermined gap therebetween, the first and second substrates forming a vacuum assembly when interconnected;

at least one anode electrode formed on a surface of the second substrate opposing the first substrate; and phosphor layers formed on the second substrate electrically connected to the at least one anode electrode.

2. The field emission display of claim 1, wherein the pair of emitters is formed at a predetermined distance from each other and closely contacting the cathode electrode.

3. The field emission display of claim 1, wherein the at pair of emitters are longitudinal and extend in a direction of the pattern of the at least one gate electrode.

4. The field emission display of claim 1, wherein the pair of emitters are carbon nanotubes.

5. The field emission display of claim 1, wherein the plurality of cathode electrodes are opaque.

6. The field emission display of claim 1, wherein the opening between each of the plurality of cathode electrodes exposes the insulation layer to the phosphor layers.

7. The field emission display of claim 1, wherein the pair of emitters are formed on one of the plurality of cathode electrodes in the overlap region.

8. The field emission display of claim 1, further comprising: a metal mesh grid mounted between the first substrate and the second substrate, and including openings corresponding to the overlap regions.

9. The field emission display of claim 1, wherein the pair of emitters are formed on the insulation layer.

10. A field emission display, comprising:

a first substrate;

a gate electrode formed on the first substrate;

an insulation layer formed next to the gate electrode;

a plurality of cathode electrodes formed on the first substrate, the plurality of cathode electrodes forming an opening between each pair of the plurality of cathode electrodes and exposing the insulation layer;

a pair of emitters formed in the opening and electrically connected to the cathode electrodes;

a second substrate opposing the first substrate, the first and second substrates forming a vacuum assembly when interconnected;

an anode electrode formed on a surface of the second substrate; and a phosphor layer formed on the second substrate electrically connected to the anode electrode.

11. The field emission display of claim 10, wherein the pair of emitters is formed at a predetermined distance from each other and closely contacting the cathode electrode.

12. The field emission display of claim 10, wherein the pair of emitters are longitudinal and extend in a direction of the pattern of the at least one gate electrode.

13. The field emission display of claim 10, wherein the pair of emitters are carbon nanotubes.

14. The field emission display of claim 10, wherein the plurality of cathode electrodes are opaque.

15. The field emission display of claim 10, wherein the pair of emitters are formed on one of the plurality of cathode electrodes in the overlap region.

16. The field emission display of claim 10, further comprising: a metal mesh grid mounted between the first substrate and the second substrate, and including openings corresponding to the overlap regions.

17. The field emission display of claim 10, wherein the pair of emitters are formed on the insulation layer.

* * * * *